United States Patent [19]

Ritchie

[11] 4,141,222

[45] Feb. 27, 1979

[54] ENERGY RECOVERY SYSTEM FOR REFRIGERATION SYSTEMS

[75] Inventor: David A. Ritchie, Altamonte Springs, Fla.

[73] Assignee: WeatherKing, Inc., Orlando, Fla.

[21] Appl. No.: 891,464

[22] Filed: Mar. 29, 1978

Related U.S. Application Data

[63] Continuation of Ser. No. 791,541, Apr. 27, 1977, abandoned.

[51] Int. Cl.[2] ..... F25B 13/00; F25B 29/00

[52] U.S. Cl. ..... 62/179; 62/238; 237/2 B; 126/362

[58] Field of Search ..... 62/185, 238, 180, 179; 237/2 B; 165/40, 35, DIG. 2; 126/362, 400; 122/20 B

[56] References Cited

U.S. PATENT DOCUMENTS

| | | | |
|---|---|---|---|
| 2,575,325 | 11/1951 | Ambrose et al. | 62/238 X |
| 3,922,876 | 12/1975 | Wetherington, Jr. et al. | 62/180 |

*Primary Examiner*—William E. Wayner

*Attorney, Agent, or Firm*—Beaman & Beaman

[57] ABSTRACT

An energy recovery system for heating water with by-product heat from a refrigeration system wherein a heat exchanger within a refrigerant compressor hot gas conduit may selectively heat water within a storage tank. The flow of water through the storage tank and heat exchanger is controlled by a pump operating during operation of the compressor, preferably, only when the heat exchanger is sufficiently heated, and a temperature sensing diverting valve causes pumped water to by-pass the heat exchanger when the water temperature within the tank reaches a predetermined maximum value.

9 Claims, 1 Drawing Figure

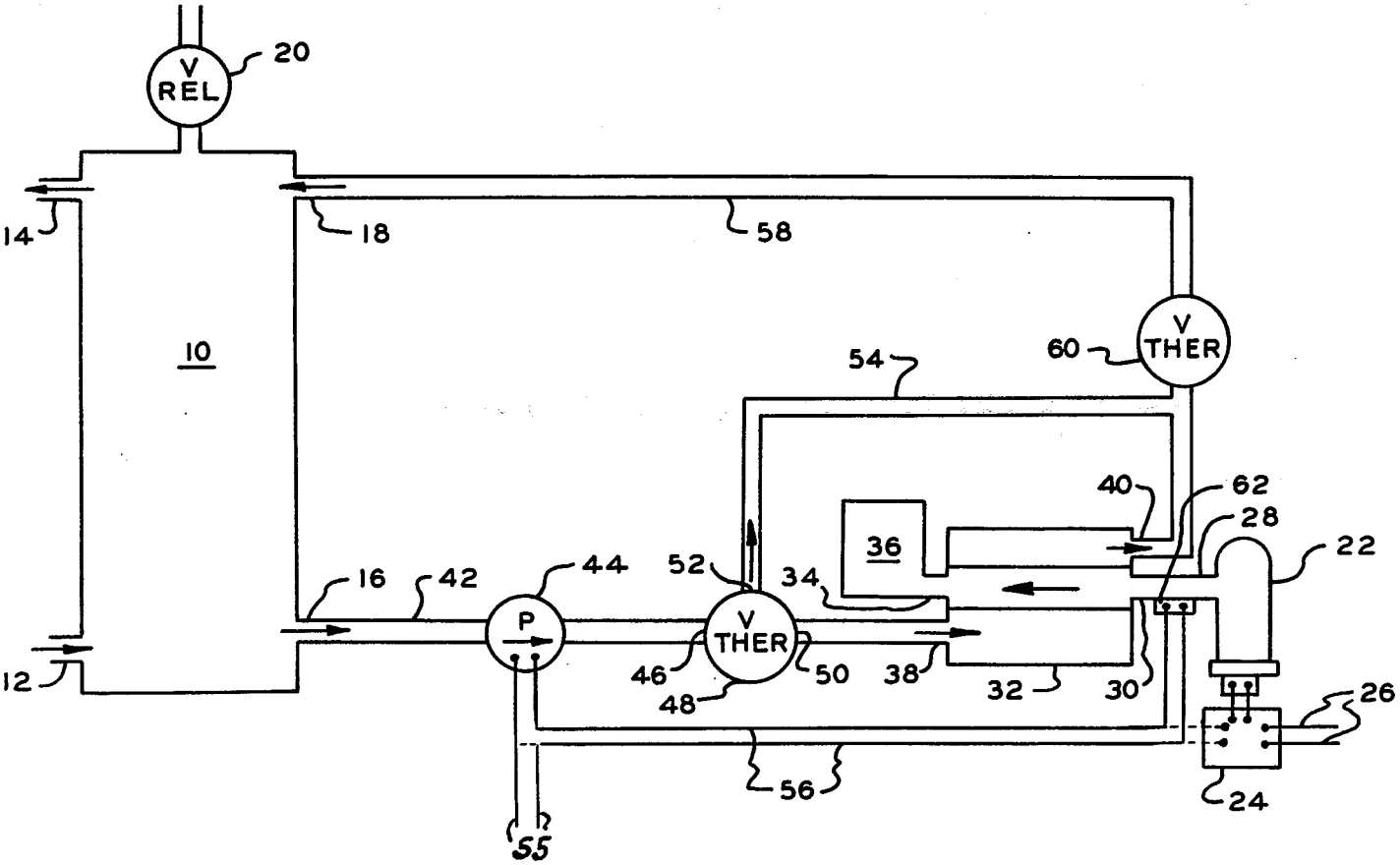
V
REL
V
THER
V
THER
P
10
12
14
16
18
20
22
24
26
28
30
32
34
36
38
40
42
44
46
48
50
52
54
55
56
58
60
62

ENERGY RECOVERY SYSTEM FOR REFRIGERATION SYSTEMS

This is a continuation of application Ser. No. 791,541 filed Apr. 27, 1977, now abandoned.

BACKGROUND OF THE INVENTION

The invention pertains to energy recovery systems utilized with refrigeration systems for heating water with refrigerant compressor by-product heat.

In a typical refrigeration circuit such as utilized in refrigeration or air conditioning apparatus, considerable heat is generated during the compression of the system refrigerant, and such heat occurs in the hot gases being compressed. The possibility of utilizing this waste heat has long been recognized. and the prior art discloses a number of arrangements wherein this heat can be recovered for practical use, usually for water heating purposes, and reference is made to U.S. Pat. Nos. 1,331,600; 1,786,861; 2,125,842 and 2,562,651.

One of the problems arising from heat recovery systems which heat water by salvaging heat from a refrigeration compressor circuit is due to the fact that the temperature of the compressor gas is considerably higher than the desired temperature of the heated water. The temperature within the compressor heat exchanger is usually above 200° F., while a desired hot water temperature for commercial and domestic use is usually between 125° and 145°. The majority of hot water storage tanks utilize safety pressure relief valves to prevent the buildup of excessive tank pressure, and such safety valves may open at 200° F. and, further, elevated tank temperatures create a serious safety hazard to hot water users.

Several types of controls have been utilized to prevent excessive water temperatures from occurring within the water storage tank in energy recovery systems used in conjunction with refrigeration apparatus. One such system is disclosed in U.S. Pat. No. 3,922,876 wherein the pump which circulates water through the hot water storage tank and the refrigeration apparatus heat exchanger is controlled by an electric switch sensing the temperature within the water being drawn from the tank, and de-energizes the circulating pump once the circulated water has reached a predetermined temperature. This patent also uses a temperature sensing blocking valve located in close proximity to the heat exchanger in order to prevent water being circulated through the storage tank which is of a temperature considerably below the desired temperature within the storage tank. While the apparatus and control system disclosed in U.S. Pat. No. 3,922,876 prevents excessive water temperatures from developing in the storage tank, and also prevents low temperature water from being introduced into the tank, this apparatus causes the circulating pump to continually cycle, and during continuous refrigeration system operation during low hot water consumption periods the water within the storage tank will be subject to stratification thereby limiting the median water temperature level within the tank. The instant invention constitutes an improvement over U.S. Pat. No. 3,922,876.

In the practice of the invention a diverting valve bypasses the circulated water around the refrigerant compressor heat exchanger upon a predetermined water temperature being achieved, and while the concept of using heat exchanger bypasses has been suggested in the prior art, note U.S. Pat. Nos. 2,700,279 and 3,926,008, such prior art devices have not utilized the economical and simplified system disclosed herein, and the prior art devices are not considered to meet the needs of apparatus of the type disclosed.

BRIEF DESCRIPTION OF THE INVENTION

It is an object of the invention to provide an energy recovery system for utilizing by-product heat from a refrigeration system for water heating purposes wherein overheating of the water is prevented, yet a maximum amount of hot water may be stored at a desired temperature range.

A further object of the invention is to provide an energy recovery system for heating hot water wherein a circulating pump is utilized and the pump will operate for relatively long cycles reducing the likelihood of pump failure, the circulating pump operating during substantially the same duty cycles as the refrigeration system compressor, preferably, only when the heat exchanger reaches a predetermined temperature.

A further object of the invention is to provide an energy recovery system for heating hot water from by-product heat from refrigeration apparatus wherein a temperature sensing diverting valve is employed in a circulating water circuit to by-pass the refrigeration compressor heat exchanger upon the circulated water achieving a predetermined maximum temperature.

In the practice of the invention a heat exchanger is interposed between a refrigeration system compressor and condenser, such system may be for refrigeration or air conditioning purposes. The heat exchanger includes an inlet and outlet for the compressed refrigerant gas, and a counterflow inlet and outlet for the water to be heated. A hot water storage tank having an inlet and outlet includes a circulating conduit system incorporating a pump which selectively circulates the stored water through the tank and the heat exchanger. The pump is connected to a control circuit so the pump will be energized only during the time the compressor is operating. In the preferred embodiment the pump control circuit includes a normally open temperature operated switch sensing the temperature of the hot gas conduit heating the exchanger whereby pumping only occurs when the heat exchanger reaches a predetermined elevated temperature. However, the pump may be energized simultaneously with the compressor operation, in an alternative embodiment, and the system will still achieve the advantages derived by selectively by-passing the heat exchanger, as described below. A temperature sensing diverting valve is interposed between the pump and the heat exchanger sensing the temperature of the water being circulated wherein the valve includes a diverting outlet which permits the circulated water to completely by-pass the heat exchanger once the water has reached its maximum desired temperature.

The use of the diverting valve permits water to continually circulate through the hot water storage tank during compressor operation, and this circulation results in a higher median water temperature level in the tank without exceeding safe temperature limits permitting a greater amount of energy to be recovered and stored as compared with known hot water heating systems used in conjunction with refrigeration apparatus.

Additionally, the present invention provides improved temperature control of the heated water due to the relatively fast response of the diverting valve.

BRIEF DESCRIPTION OF THE DRAWING

The aforementioned objects and advantages of the invention will be appreciated from the following description and accompanying drawing illustrating a schematic circuit of the energy recovery system in accord with the invention.

DESCRIPTION OF THE PREFERRED EMBODIMENT

With reference to the drawing a hot water storage tank is represented at 10 having a supply water inlet 12, and an outlet 14 connected to the hot water distribution system. The hot water tank also includes an outlet 16 at its lower region, and an inlet 18 at its upper region whereby the heating circulating system in accord with the invention communicates with the hot water tank. As is the usual practice, a pressure relief valve 20 may be located at the upper region of the tank for safety purposes.

The energy recovery system in accord with the invention recovers by-product heat from a refrigeration system as may be utilized with air conditioning apparatus, a refrigerator, or the like. This refrigeration system includes an electric driven compressor 22 electrically connected to controls 24 supplied by conductors 26. The compressor includes a hot compressed gas outlet conduit 28 communicating with the inlet 30 of heat exchanger 32, and the heat exchanger outlet 34 communicates with the refrigeration apparatus condenser 36. During operation of the compressor 22 the hot refrigerent gas compressed is passed through the heat exchanger 32 providing a heat source therefore. The heat exchanger 32 may be of any conventional construction suitable for use with exchanging heat between refrigerent pressurized gas and water, and such an exchanger is commercially available from Edwards Engineering Corp. of Pompton Plains, N.J. or Packless Industries of Mount Wolf, Pa.

The heat exchanger includes an inlet at 38 for the medium to be heated, and a medium outlet is located at the opposite heat exchanger end at 40.

A conduit 42 communicates with the hot water tank outlet 16 and the heat exchanger inlet 38, and flow through conduit 42 is controlled by an electrically driven pump 44. The output from the pump 44 communicates with an inlet 46 of a temperature sensing thermostatic diverting valve 48. The valve 48 includes an outlet 50 forming part of the conduit 42, and the valve also includes a diverting outlet 52. The temperature sensing valve 48 senses the temperature of the water entering the valve at inlet 46, and the valve has a set point range between 120° F. to 160° F. and is preset whereby water temperature below its' set point cause the valve to open outlet 50 permitting water to flow into the heat exchanger 32. If the water temperature within conduit 42 is above its' set point the valve closes outlet 50, and opens diverting outlet 52 to permit the water flow to enter by-pass conduit 54. The particular construction of valve 48 forms no part of the present invention, a suitable valve being commercially available from H & H Thermostat Division of Emerson Electric Company of Cedar Grove, N.J.

In the preferred embodiment the electric motor driving the pump 44 is energized by supply conductors 55 and switch conductors 56 and the conductors 56 are both energized only if the heat exchanger has reached a predetermined temperature. Such related heat exchanger temperature and pump operation prevents "short cycling" of the pump, as it causes water to flow through the heat exchanger 32 only when hot gases are passing through the heat exchanger.

The heat exchanger outlet 40 communicates with the return conduit 58 connected to the hot water inlet 18, and the by-pass conduit 54 connects to the return conduit, as illustrated. Thus, water flow through the valve 48 into the by-pass conduit 54 returns the water to the hot water inlet 18 without being heated, while opening of the valve 48 to permit water flow into the heat exchanger 32 permits heated water to enter conduit 58 and the water heater tank 10.

Preferably, a thermally operated hold back valve 60 is located in the return conduit 58 adjacent to and downstream of the junction of by-pass conduit 54 with return conduit 58. The purpose of hold back valve 60 is to prevent water flow through the energy recovery system until the temperature of the water within the system at valve 6 is hot, usually about 130° to 140° F. in a residential hot water system, and the valve 60 will stay closed until this temperature is reached within the heat exchanger. The valve 60 is located as close to heat exchanger 32 as possible in order to sense the temperature of the water heated thereby.

A temperature sensing electric switch 62 is mounted on compressor conduit 28 to close when conduit 28 becomes sufficiently hot, about 130°–150° F., and switch 62 is in series with conductors 56 between pump 44 and supply conductor 55 whereby the pump will not be energized until the heat exchanger has reached a predetermined temperature.

In operation, the compressor 22 will operate in accord with the demand for refrigeration as controlled by a thermostat or other control, not shown, sensing the temperature of the space to be cooled. Upon energizing of the compressor hot refrigerent gas from the compressor flows through the heat exchanger 32 into the condenser 36. Soon after the compressor starts the conduit 28 becoming sufficiently hot to close switch 62 to energize pump 44 causes water to be drawn from the hot water tank outlet 16 into conduit 42. Assuming the temperature of the water entering valve 48 to be less than its' set point, the valve 48 will be so positioned that flow occurs through outlet 50, and outlet 52 is closed. Thus, water will flow through the conduit 42, heat exchanger 32 and return conduit 58 back into the water heater tank to raise the temperature of the stored water. Of course, if hold back valve 60 is employed in the system the temperature of the water at valve 60 must be sufficient to open the valve, and valve 60 will prevent cool water from being returned to tank 10. This circulating operation continues as long as the temperature within the tank 10 is below the maximum desired as determined by the set point of diverting valve 48, and as long as the compressor 22 and pump 44 are energized.

Assuming that the water temperature within tank 10 and conduit 42 reaches a maximum desired value as sensed by valve 48, outlet 50 will be closed and diverting outlet 52 opened whereby water flow is now through by-pass conduit 54, returning water to the water heater tank without the addition of heat thereto. If the temperature of the recirculating water lowers to the minimum range preset in valve 48 the valve will automatically operate to open outlet 50 and close outlet 52 to again cause the water to flow through the heat exchanger 32 and accumulate heat within the tank 10.

It will therefore be appreciated that constant circulation of water within tank 10 occurs whenever the compressor 22 is in operation and the heat exchanger is hot enough to close switch 62 and open valve 60. These long cycles of pump operation produce a high median water temperature within the tank due to minimum stratification of temperature levels within the hot water tank and a greater amount of heat energy can be stored and recovered in the tank without exceeding safe temperature limits than in a system wherein recirculation only occurs during heating, or in short circulation cycles. The heat recovery system of the invention also has the advantage of producing improved temperature control of the heater water due to the relatively fast response of the temperature sensing valve 48 with respect to the direction of waterflow therethrough. Also, as the pump 44 is prevented from operating on short cycles its length of life will be extended as compared to an operation wherein the pump is constantly being turned on and off.

It will be appreciated that the purpose of the switch 62 and hold back valve 60 is to prevent cold water from being introduced into tank 10 when the compressor is started after an extended shut down whereby water within the conduits has cooled. The valve 60 can be eliminated from the system without affecting the basic operation of the system, i.e. the selective by-passing of the heat exchanger to prevent excessive water temperatures in the tank 10, but its use is preferred.

Also, it is possible to eliminate the use of switch 62 if the pump 44 is directly wired to the compressor control 24 so that the pump will operate whenever the compressor is energized. In such an instance both conductors 56 are connected to control 24 and pump 44 as shown in dotted lines and switch 62 and conductors 55 are eliminated. The preferred embodiment described using conductors 55 and switch 62 has the advantage of not breaking into the compressor circuit and imposing an additional load thereon and controls and relays are eliminated if the compressor circuit is high voltage and the pump 44 requires a lower voltage, as is usually the case.

Various modification to the inventive concept may be apparent to those skilled in the art departing from the spirit of the invention.

I claim:

1. An energy recovery system for heating with by-product heat from a refrigeration system comprising, in combination, an electrically driven refrigeration compressor having a hot compressed gas outlet conduit and electric controls, a hot water storage tank having an inlet and an outlet, a heat exchanger heated by said hot gas conduit and having an inlet and an outlet, a first conduit communicating with said storage tank outlet and connected to said exchanger inlet, an electric pump within said first conduit operatively associated with said compressor whereby energizing of said pump only occurs during operation of said compressor, a temperature sensing diverting valve within said first conduit intermediate said pump and said heat exchanger selectively controlling water flow to said heat exchanger and sensing the temperature of the water within said first conduit, said valve including a diverting outlet communicating with a heat exchanger by-pass conduit communicating with said tank inlet whereby flow through said valve is through said diverting outlet and by-pass conduit upon the temperature of the water within said valve and first conduit attaining a predetermined maximum value, and a second conduit connecting said heat exchanger outlet to said tank inlet whereby during compressor and pump operation said diverting valve selectively circulates water from said storage tank through said heat exchanger in dependence upon the temperature of the water within said tank and said first conduit.

2. In an energy recovery system for heating water as in claim 1 wherein said diverting valve is normally open to permit flow through said first conduit between said tank outlet and heat exchanger inlet during operation of said pump.

3. In an energy recovery system as in claim 2, said valve diverting outlet communicating with said second conduit intermediate said heat exchanger outlet and said tank inlet.

4. In an energy recovery system as in claim 1, a normally open temperature sensing electric switch sensing the temperature of said hot compressed gas outlet conduit adapted to close upon the temperature of said hot gas outlet conduit reaching a predetermined elevated temperature, said switch controlling operation of said pump in dependence upon the temperature of said hot gas outlet conduit.

5. In an energy recovery system as in claim 4, wherein said temperature sensing electric switch is connected to and in series with an electric power supply separate from said compressor electric controls.

6. In an energy recovery system as in claim 1, electric conductors connecting said compressor electric controls to said pump whereby said pump is energized upon energizing of said compressor.

7. A method of wasted heat recovery from an "on" and "off" cycle space heating and/or cooling system through storage of the wasted heat in a hot water system with an accompanying reduction in stratification in the hot water system and maintenance of water circulation means comprising the steps of:

a. placing the source of wasted heat of the space heating and/or cooling system in heat exchange relation with the storage tank of the hot water system through water conduit means;
b. circulating water between the two systems to store the wasted heat in the storage tank with a resulting reduction of stratification in the storage tank;
c. cycling said source of wasted heat to provide a cycling source of heat for said storage tank;
d. effecting the circulation of water between said systems by means operated in relation to the cycle of operation of the space heating and/or cooling system to reduce maintenance of such means;
e. sensing the temperature of the water being circulated upstream from the exchange with wasted heat, and
f. bypassing the circulated water normally in heat exchange relation with the source of wasted heat when the said upstream temperature exceeds a predetermined amount to provide over temperature protection for the hot water system.

8. A method as defined in claim 7 wherein the "on" and "off" cycling of the space heating and/or cooling system directly controls the water circulation.

9. A method as defined in claim 7 wherein the water circulation is controlled by the temperature of the source of the wasted heat.

* * * * *